US005496243A

United States Patent [19]

Allen

[11] Patent Number: 5,496,243

[45] Date of Patent: Mar. 5, 1996

[54] BARBELL USING DUMBBELLS AS WEIGHT

[76] Inventor: D. Mason Allen, 9202 Beauclerc Circle West, Jacksonville, Fla. 32257

[21] Appl. No.: 343,338

[22] Filed: Nov. 21, 1994

[51] Int. Cl.[6] ..... A63B 21/072

[52] U.S. Cl. ..... 482/106

[58] Field of Search ..... 482/93, 104, 105–108; 403/233, 234, 237

[56] References Cited

U.S. PATENT DOCUMENTS

| | | | |
|---|---|---|---|
| 1,366,200 | 1/1921 | Matysek | 482/108 |
| 3,756,597 | 9/1973 | Monti . | |
| 4,252,316 | 2/1981 | Price | 482/106 |
| 4,484,740 | 11/1984 | Green | 482/108 |
| 5,314,394 | 5/1994 | Ronan | 482/104 |

*Primary Examiner*—Richard J. Apley

*Assistant Examiner*—John Mulcahy

*Attorney, Agent, or Firm*—William M. Hobby, III

[57] ABSTRACT

A weight lifting bar apparatus includes an elongated cylindrical lifting bar and has a bracket attached to each end thereof. Each bracket has an elongated slide extending transversely to the lifting bar and a latching cover for covering the elongated slot. Each of a pair of dumbbells has a handle bar portion between a pair of weighted ends with the handle bar sized to fit into the bracket elongated slot and to be removable latched therein so that a pair of dumbbells can be used as weights for a barbell. One embodiment has the brackets fixedly attached to each end of the bar with a latching cover slidable on the bar to cover the transverse slot. Another embodiment has the brackets removably attached to each end of the bar and locks the dumbbells in place by having the elongated slot slidable beneath the barbell bar and uses a locking collar to lock each bracket in place.

5 Claims, 1 Drawing Sheet

BARBELL USING DUMBBELLS AS WEIGHT

BACKGROUND OF THE INVENTION

The present invention relates to weight lifting devices and more specifically to a barbell device which can utilize a pair of dumbbells for the weights for barbells and allows the dumbbells to be removed for separate use.

In the past, it has been common to provide a great variety of weight lifting devices but the most commonly used device consist of a barbell having an elongated cylindrical lifting bar having a rotatable sleeve mounted thereto and having a pair of collars on each end which are threadably locked to the lifting bar. Disk-shaped weights are placed on the bar between the locking collars for holding the weights on either end. Other exercising devices include dumbbells which generally have a bar handle having weights on either end thereof. Dumbbells are usually provided in pairs so that one can be held in each hand for doing lighter-type exercise routines.

The present invention is directed towards a combination device in which the dumbbells can be utilized as a barbell weights or for added weight to the lifting bar and which can thereby be sold as a kit for doing exercise routines with both the dumbbells and a barbell.

In the prior art U.S. patent to Matysek, U.S. Pat. No. 1,366,200 for an exercising device, a bar is provided having a number of apertures therethrough and a pair of dumbbells each having a large aperture therethrough sized to slide onto the end of the barbell bar. A pair of cotter pins or the like can then be slid through the apertures in the bar on either side of the dumbbell to lock the dumbbells in place to provide dumbbells on a barbell type bar. This prior system has the disadvantage in that the dumbbell handles have to be large enough to have an aperture that will slide onto a barbell bar and still give sufficient strength in the handles. The handles then become unduly large and this requires custom made dumbbells which do not comfortably fit the hands of the user. In addition, sliding the pins in and out of the barbell can also be a difficult task. In this patent, hollow dumbbells are provided which can be filled with a substance to add weight to the dumbbell. In the Price, U.S. Pat. No. 4,252,316, a weight lifting bar is provided which has a hanger including a sleeve which slides onto either end of a barbell bar and has a perpendicular bar for attaching a plurality of disk weights placed at right angles to the bar. The attachment has other variations but includes a threaded lock built into the accessory sleeve. In the Monti patent, U.S. Pat. No. 3,756,597, a push-pull type weight shaft exercising device includes a weight lifting shaft having hand grips positioned on either end thereof. A weighted member fits outside of each hand grip onto the bar. The weighted members have apertures therein which allow a bolt to slide therethrough for threadedly attaching into the end of the weight lifting shaft. Each weight includes a container for filling with water or a substance to add weight to the exercising device.

In contrast to the prior art devices, the present invention allows a pair of dumbbells to be sold along with a single barbell type bar with special brackets so that conventional dumbbells which a person already has or may purchase with the kit can be used as weights on the barbell and can be used separately for dumbbell exercise routines.

SUMMARY OF THE INVENTION

A weight lifting bar apparatus includes an elongated cylindrical lifting bar and has a bracket attached to each end thereof. Each bracket has an elongated slide extending transversely to the lifting bar and a latching cover for covering the elongated slot. Each of a pair of dumbbells has a handle bar portion between a pair of weighted ends with the handle bar sized to fit into the bracket elongated slot and to be removable latched therein so that a pair of dumbbells can be used as weights for a barbell. One embodiment has the brackets fixedly attached to each end of the bar with a latching cover slidable on the bar to cover the transverse slot. Another embodiment has the brackets removably attached to each end of the bar and locks the dumbbells in place by having the elongated slot slidable beneath the barbell bar and uses a locking collar to lock each bracket in place.

BRIEF DESCRIPTION OF THE DRAWINGS

Other objects, features, and advantages of the present invention will be apparent from the written description and the drawings in which.

DETAILED DESCRIPTION OF THE PREFERRED EMBODIMENTS

Figure 1:
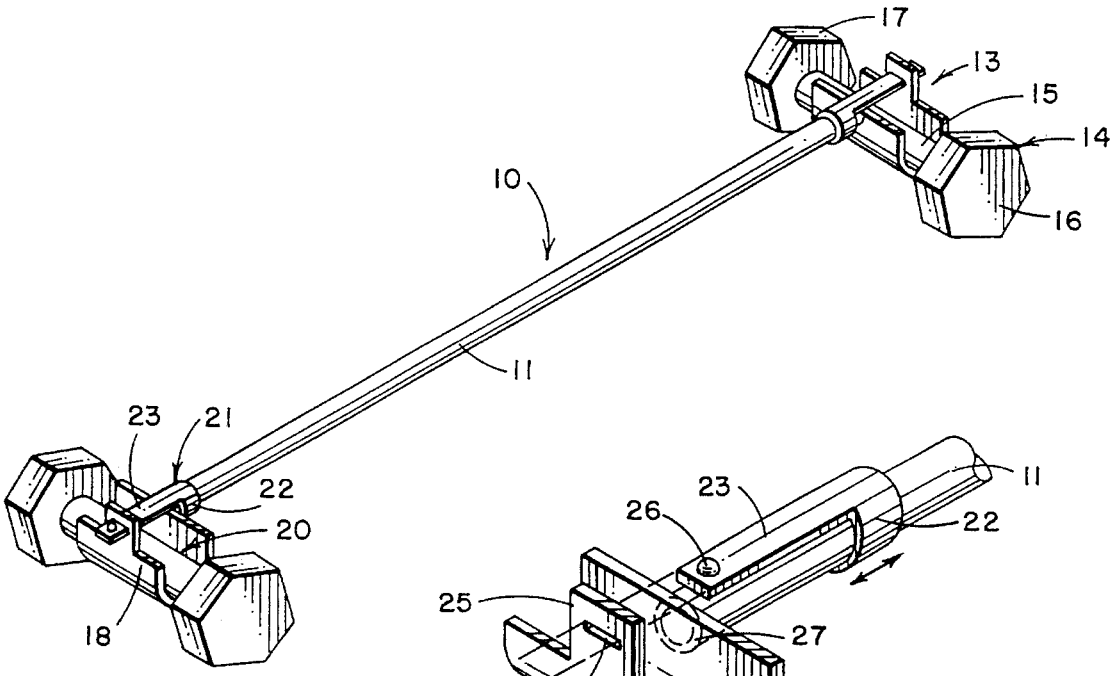
FIG. 1 is a perspective view of a weight lifting apparatus in accordance with my invention.
Figure 2:
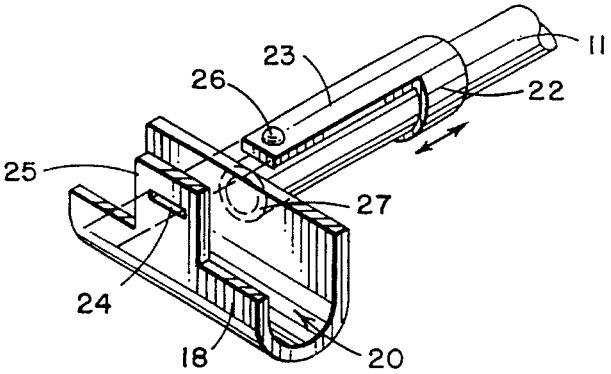
FIG. 2 is a perspective view of one end of the apparatus of FIG. 1.

Referring to the drawings and especially to FIGS. 1 and 2, a weight lifting apparatus 10 includes an elongated cylindrical lifting bar or steel pipe 11 having a bracket 13 on either end thereof. The brackets, as shown in FIG. 1, have a conventional dumbbell 14 mounted thereto. The dumbbell 14 is made up of a bar or handle bar 15 having a weight 16 on one end and a weight 17 on the other end thereof. The bracket 13 has a generally U-shaped holder 18 which forms an elongated slot 20 which is transverse or perpendicular to the bar 11 and is sized to hold the dumbbell handle bar 15 therein. The bracket 13 has a latching cover 21 having a collar 22 slidably mounted on the bar 11 to slide an arm 23 back and forth for opening the slot 20 for adding or removing a dumbbell 14. The arm 23 is exactly positioned to slide into a slot 24 in an upwardly extending latching portion 25 so that a latching raised knob 26 slides through the slot 24 so that the raised knob forces bar 23 downward as it passes through slot 24 and thereby latches on the opposite side of the slot 24 to hold the arm 23 over the U-shaped slots 20. The U-shaped bracket member 18 may be welded to the end 27 of the bar 11 which, in this case, is shown as a steel pipe but it should be clear that the bar 11 can also be a solid steel rod and can be attached in different manners as desired without departing from the spirit and scope of the invention.

Figure 3:
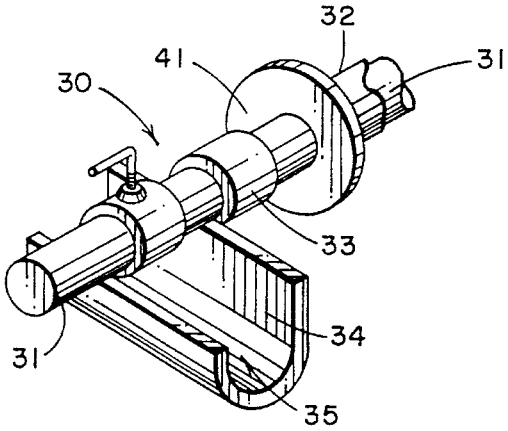
FIG. 3 is a perspective view of one end of a second embodiment of a weight lifting apparatus.
Figure 4:
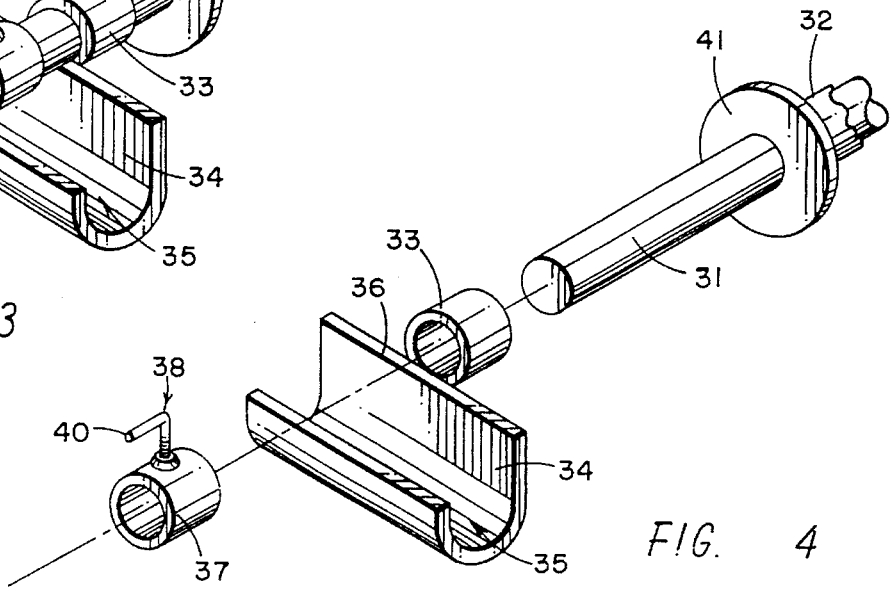
FIG. 4 is an exploded perspective view of FIG. 3.

Turning to FIGS. 3 and 4, an alternate embodiment of the present invention is shown in which a bracket 30 is removably attached to a weight lifting or barbell bar 31 which is shown as a solid steel bar and has a stopping sleeve 32 attached thereover but which sleeve is shorter than the overall length of the bar 31. The bracket 30 includes a supporting collar 33 attached to a generally U-shaped bracket member 34 forming an elongated slot 35 which extends transversely of or perpendicular to the bar 31 when the collar 33 is slid onto the bar 31. The collar 33 is attached along the top edge 36 of the U-shaped member 34, so that when collar 33 is slid onto the bar 31, bar 31 will extend over the slot 35 and thus lock the handle 15 of a dumbbell 14 in place. A separate locking collar 37 is sized to also slide onto the bar 31 and has a threaded fastener 38 threaded thereinto which has a handle 40. The collar 37 can be slid onto the bar 31 and the handle 40 rotated to tighten the threaded fastener 38 onto the bar 31 and lock the collar 37 in place. This allows the bracket 30 to be locked onto the end of a barbell between the stopping sleeve 32 which may have an end disc 41 thereon for blocking one end of disc weights.

Thus, a conventional bar 31 can have the bracket 30 slid onto each end thereof and locked in place with the collar 37 to lock a dumbbell 14 on each end thereof. The dumbbell must be inserted in the U-shaped slot and then the collar 33 slid onto the bar 31 to thereby lock the dumbbell 14 in the transverse lock 35 with the end of the barbell bar 31 sliding over the slot 35 to act as the cover therefor.

It should be clear at this time that a weight lifting and exercising device has been provided which has the advantage of using conventional dumbbells which can be rapidly converted for using the dumbbells as weights on a barbell for additional exercise routines. However, the present invention is not to be construed to the forms shown which are to be considered illustrative rather than restrictive.

I claim:

1. A weight lifting bar comprising:

an elongated cylindrical lifting bar;

a bracket attached to each end of said elongated cylindrical bar, each bracket having an elongated slot extending transversely to said lifting bar and each bracket having a latching cover over said elongated slot, said latching cover having a collar slidably mounted on said elongated cylindrical lifting bar whereby said latching cover can slide over said elongated slot; and a pair of dumbbells each having a handle bar portion between a pair of weighted ends, said handle bar portion being sized to fit into said bracket elongated slot and to be removably latched therein, whereby a pair of dumbbells are used as weights for a barbell.

2. A weight lifting bar in accordance with claim 1 in which each said bracket is fixedly attached to said elongated cylindrical lifting bar.

3. A weight lifting bar in accordance with claim 1 in which each said bracket latching cover has a sliding arm attached to said slidable collar and said bracket has a latching slot on one side thereof aligned to receive said sliding arm therethrough for latching said arm over said elongated slot.

4. A weight lifting bar in accordance with claim 3 in which each said bracket latching cover sliding arm has latching means on one end portion thereof for holding said arm in said bracket latching slot.

5. A weight lifting bar in accordance with claim 1 in which said elongated cylindrical lifting bar is a hollow steel pipe.

* * * * *